US005201518A

United States Patent [19]

Isoda

[11] Patent Number: 5,201,518

[45] Date of Patent: Apr. 13, 1993

[54] SHEET TRANSPORT MECHANISM HAVING FLAPPER

[75] Inventor: Yuzo Isoda, Yokohama, Japan

[73] Assignee: Canon Kabushiki Kaisha, Tokyo, Japan

[21] Appl. No.: 938,530

[22] Filed: Sep. 2, 1992

Related U.S. Application Data

[63] Continuation of Ser. No. 672,033, Mar. 19, 1991, abandoned.

[30] Foreign Application Priority Data

Mar. 24, 1990 [JP] Japan ..... 2-74093

[51] Int. Cl.[5] ..... B65H 39/10

[52] U.S. Cl. ..... 271/305; 271/287; 271/297; 355/321

[58] Field of Search ..... 271/303, 305, 302, 291, 271/297, 287–289, 278; 355/308, 309, 318, 319, 321, 323

[56] References Cited

U.S. PATENT DOCUMENTS 4,444,388 4/1984 Stefannson et al. ..... 271/305 X
4,650,178 3/1987 Steele et al. ..... 271/305
4,998,716 3/1991 Okumura et al. ..... 271/305 X
5,013,028 5/1991 Tajima et al. ..... 271/305

FOREIGN PATENT DOCUMENTS 0193267 9/1986 European Pat. Off. .
0225240 6/1987 European Pat. Off. .
61-45854 3/1986 Japan .

*Primary Examiner*—R. L. Moses
*Attorney, Agent, or Firm*—Fitzpatrick, Cella, Harper & Scinto

[57] ABSTRACT

A sheet transport mechanism includes a plurality of transport paths, a transport roller provided at a branch section at which the transport paths are branched, a flapper provided at the branch section to select one of the plurality of transport paths and to guide a sheet member into the selected transport path by changing its posture, and a flapper roller supported on the flapper, the flapper roller pinching the sheet member in cooperation with the transport roller to transport the sheet member. The flapper roller is urged toward the transport roller by its weight and/or a spring force.

12 Claims, 5 Drawing Sheets

SHEET TRANSPORT MECHANISM HAVING FLAPPER

This application is a continuation of application Ser. No. 07/672,033 filed Mar. 19, 1991, now abandoned.

BACKGROUND OF THE INVENTION

1. Field of the Invention

This invention relates to a sheet transport mechanism having a flapper and, more particularly, to a sheet discharge mechanism provided in, for example, an image forming apparatus such as a printer or a copier, having a plurality of sheet discharge ports, and capable of changing over the discharge port by a flapper.

2. Related Background Art

Conventionally, for image forming apparatuses, e.g., printers, a mechanism is provided which includes a plurality of ports through which sheets of paper used for recording are discharged.

FIG. 1 schematically shows a section of an example of a conventional printer having a sheet transfer mechanism of this kind. As illustrated in FIG. 1, a toner image formed on the circumferential surface of a photosensitive drum 1 rotated in the direction of the arrow by an image forming means which is known per se is transferred to a sheet S which is pressed against the photosensitive drum 1 by a transfer roller 2. After receiving the toner image, the sheet S is transported while being guided by a sheet discharge guide 5*a* to a fixing device 3 to fix the toner image. The fixing device 3 is composed of a fixing roller 3*a* and a driven roller 3*b*. The driven roller 3*b* is pressed against the fixing roller 3*a* to rotate by following the fixing roller 3*a*. The sheet S is further transported to a pair of face-up (F/U) sheet discharge rollers 6 (which make the image of characters or the like face upward) while being guided by a sheet discharge guide 5*b*. The pair of F/U sheet discharge rollers 6 consist of a sheet discharge roller 6*a* and a driven sheet discharge roller 6*b* contacting and following the roller 6*a*.

On the downstream side of the pairs of F/U discharge rollers 6, a flapper (branch means) for changing the direction of discharge of the sheet S is disposed. When positioned as indicated by the double-dot-dash line, the flapper 7 guides the sheet S to the discharged sheet tray 9 to discharge the sheet S without inversion thereof. The sheet S is thereby placed on the tray 9 in a face-up position. When the flapper 7 is at the position indicated by the solid line, the sheet S discharged from the pair of F/U sheet discharge rollers 6 is guided by a guide member 10 so as to be inverted with respect to its two surfaces and is discharged onto a discharged sheet tray 12 by a pair of face-down (F/D) sheet discharge rollers 11 consisting of a sheet discharge roller 11*a* and a driven sheet discharge roller 11*b* contacting the roller 11*a*. The sheet S is thereby placed in a face-down position.

FIG. 2 shows another example of the conventional printer wherein an F/U sheet discharge roller 6*a* and a flapper (branch means) 13 having guide edges 13*a* positioned above and in the vicinity of the F/U sheet discharge roller 6*a* are disposed on the downstream side of the fixing device 3. The flapper 13 is rotatably supported by a support shaft 15.

Sheet S on which a toner image is fixed by the fixing device 3 is transported as described below. When the flapper 13 is at the position indicated by the solid line in FIG. 2, the direction of transportation is changed to the direction of the discharged sheet tray 9 by the flapper 13, and the sheet S is discharged onto the discharged sheet tray 9 via the gap between the F/U sheet discharge roller 6*a* and the flapper 13. When the flapper 13 is positioned by being turned counterclockwise from the position indicated in FIG. 2, the sheet S is guided by the flapper 13 and the guide member 10 so as to be inverted with respect to its two surfaces and is discharged so as to be placed on the discharged sheet tray 12 in a face-down position by the pair of F/D sheet discharge rollers 11.

In the above-described sheet discharge mechanism shown in FIG. 1, however, the pair of F/U sheet discharge rollers 6 are positioned on the downstream side of the fixing device and the flapper 7 for changing the direction of transportation of sheet S is disposed downstream of the rollers 6. The space occupied by the mechanism is therefore considerably large. This type of mechanism also entails the problem of a deterioration in transport performance owing to a change in the state of the pair of F/U sheet discharge rollers 6 with time due to wear thereof, since the F/U sheet discharge rollers 6 are always in contact with each other.

The sheet discharge mechanism shown in FIG. 2 is smaller than the mechanism shown in FIG. 1, thanks to the structure wherein no pair of F/U sheet discharge rollers corresponding to the above-described pair of F/U sheet discharge rollers 6 are provided on the downstream side of the fixing device 3. In this mechanism, however, the sheet transporting force applied from the F/U sheet discharge roller 6*a* is so small that the possibility of failure to discharge the sheet at the time of F/U sheet discharging is high.

SUMMARY OF THE INVENTION

In view of the above-described related art, an object of the present invention is to provide a sheet transport mechanism reduced in size while maintaining the force for transporting the sheet.

To achieve this object, according to the present invention, there is provided a transport mechanism including a transport rotary member, flapper means opposed to the transport rotary member, and a transport roller provided on the flapper means to pinch a sheet member in cooperation with the transport rotary member.

According to the present invention, diversion means for selecting one of a plurality of sheet transport paths is provided in, for example, a sheet transport section having a transport roller. It is thereby possible to transport the sheet in the selected sheet transport path without providing any special sheet discharge roller and, hence, to reduce the space occupied by the sheet transport mechanism. When the sheet is transported through the path selected by the branch means, the sheet can be correctly guided into the selected path, because the branch means has a roller for pressing the sheet against the transport roller.

DESCRIPTION OF THE PREFERRED EMBODIMENTS

Figure 1:
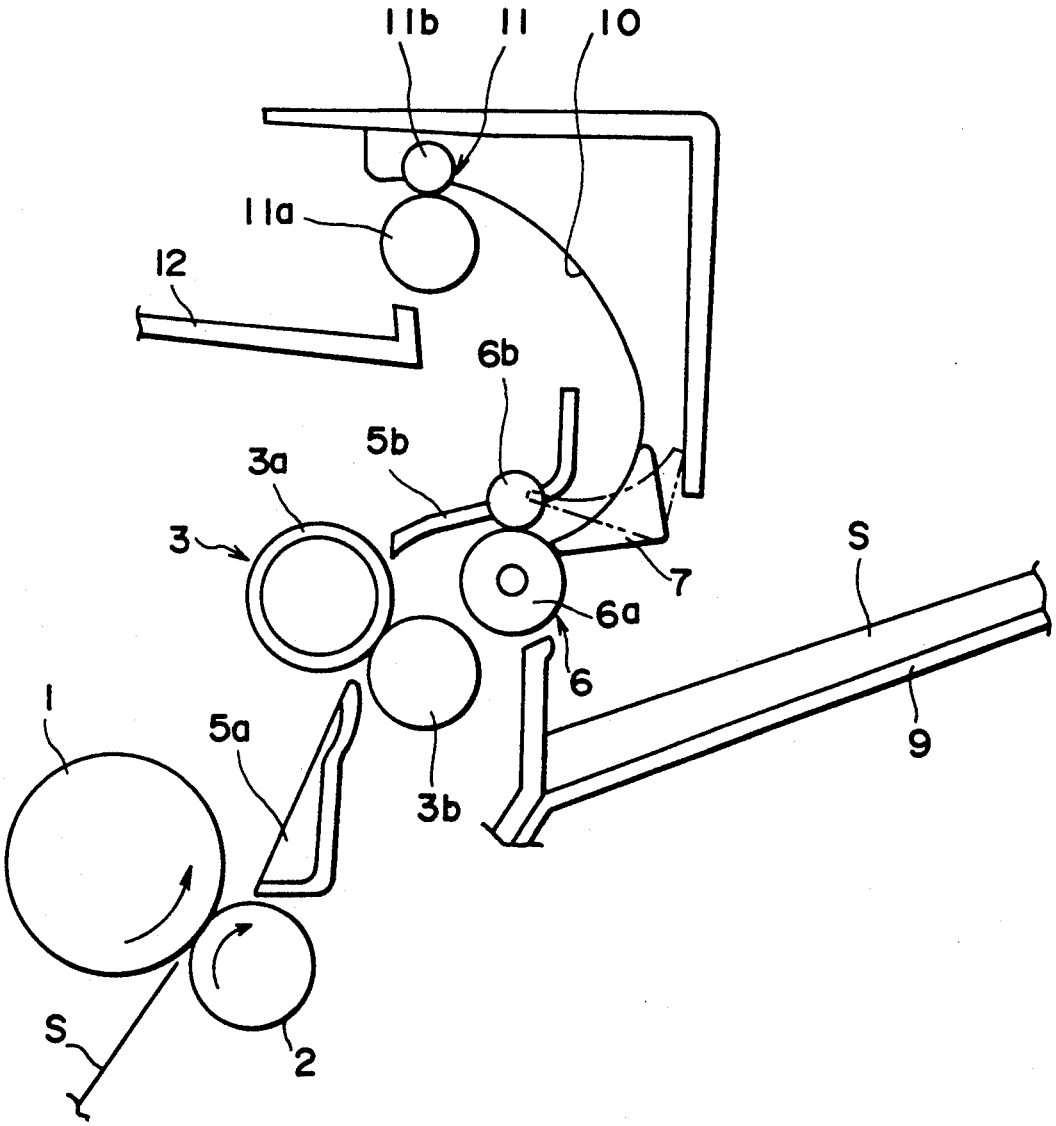
FIG. 1 PRIOR ART
FIG. 1 is a longitudinal sectional side view of an example of the conventional sheet discharge mechanism.
Figure 2:
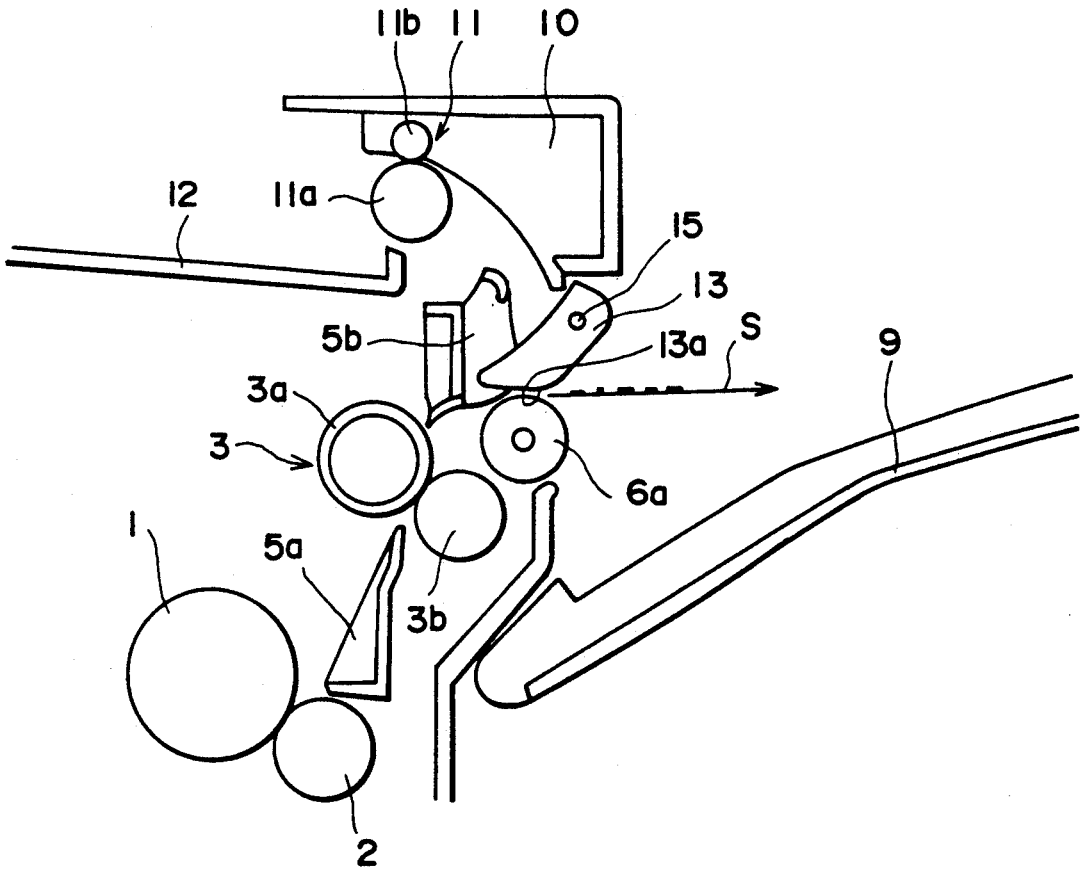
FIG. 2 PRIOR ART
FIG. 2 is a longitudinal sectional side view of another example of the conventional sheet discharge mechanism.

An embodiment of the present invention will be described below with reference to FIGS. 3 to 5. Components of this embodiment having the same functions as those shown in FIGS. 1 and 2 are indicated by the same reference characters, and the description for them will not be repeated.

Figure 3:
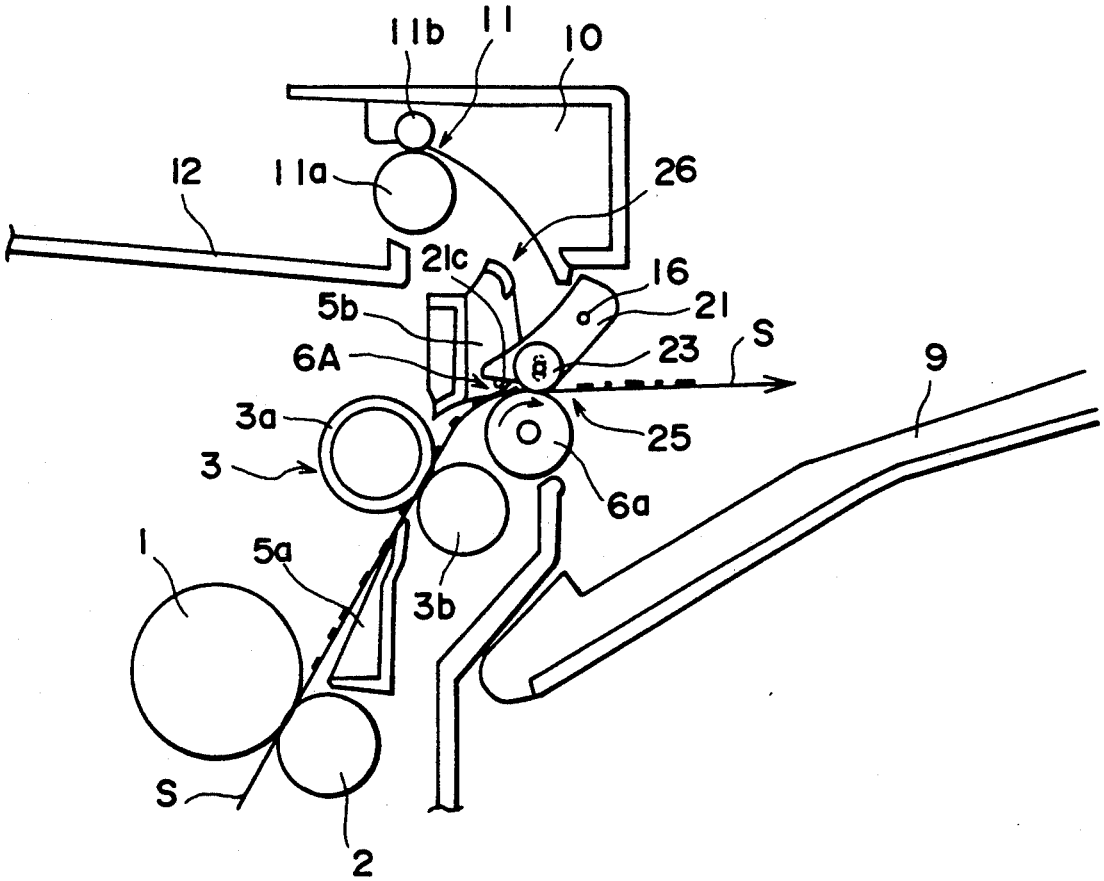
FIG. 3 is a longitudinal sectional side view of a sheet discharge mechanism in accordance with a first embodiment of the present invention at the time of face-up sheet discharging.

Referring to FIG. 3, an F/U sheet discharge roller 6*a* is disposed on the downstream side of a fixing device 3, and the F/U sheet discharge roller 6*a* and a sheet discharge guide 5*b* constitute a sheet discharge section 6A for discharging sheet S supplied from the fixing device 3. A flapper (branch means) 21 is disposed above the F/U sheet discharge roller 6*a*. When the flapper 21 is at the position indicated by the solid line, sheet S discharged from the fixing device 3 is guided by lower edges 21*c* of the flapper 21 to a discharged sheet tray 9.

Figure 4:
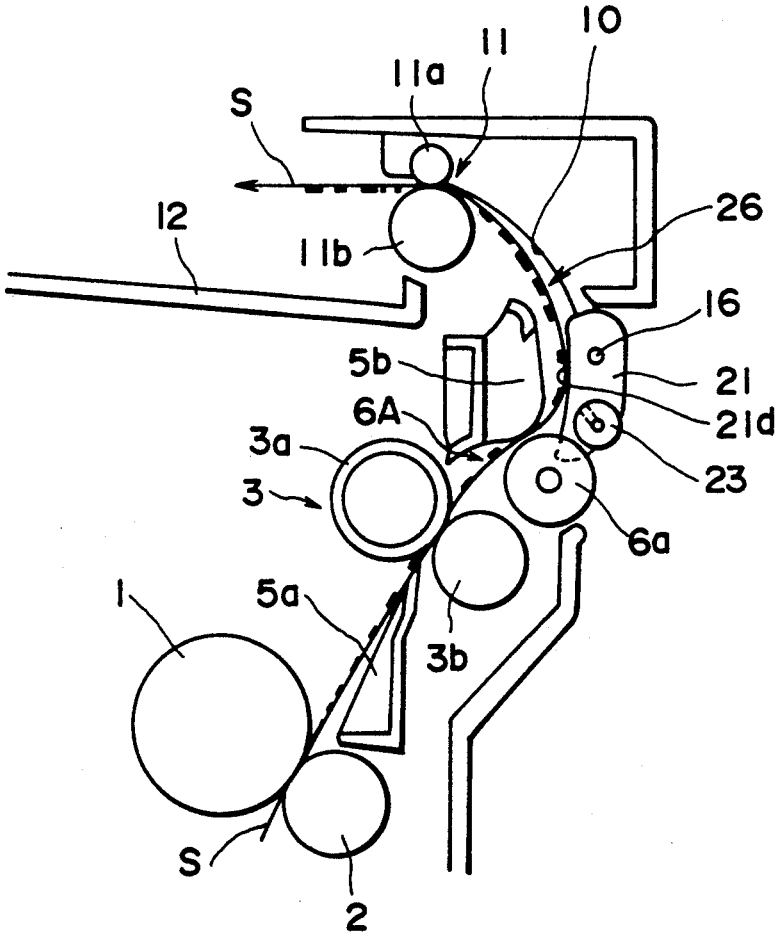
FIG. 4 is a longitudinal sectional side view of the first embodiment at the time of face-down sheet discharging.
Figure 5A:
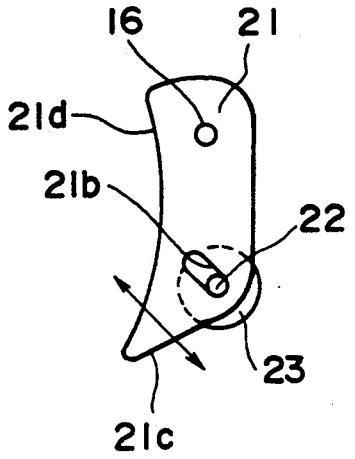
FIG. 5A is a side view of the branch means (flapper)
Figure 5B:
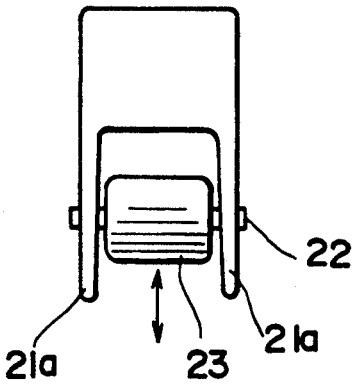
FIG. 5B is a front view of the branch means shown in FIG. 5A.

The flapper 21 has a pair of left and right arms 21*a*, as shown in FIGS. 5A and 5B. A support shaft 22 on which a roller 23 is fixed has opposite ends loosely fitted in elongated holes 21*b* respectively formed in the arms 21*a*. The flapper 21 can be rotated to an F/U position shown in FIG. 3 or to an F/D position shown in FIG. 4 by a drive mechanism including a plunger or the like. When the flapper 21 is at the F/U position shown in FIG. 3, the roller 23 is maintained in contact with the F/U sheet discharge roller 6*a* by its weight. The plunger is operated to change the position of the flapper 21 by a command from a control unit. The operator instructs the control unit by the selection of F/U of F/D.

A first sheet transport path 25 which leads sheet S to the discharged sheet tray 9 is defined by an upper circumferential surface of the F/U sheet discharge roller 6*a* and the lower edges 21*c* of the flapper 21. A second sheet transport path 26 is defined by inner side edges 21*d* of the flapper 21, the sheet discharge guide 5*b*, a guide member 10 and other components.

When the flapper 21 is in the F/U position as shown in FIG. 3, sheet S on which a toner image has already been fixed by the fixing device 3 is led into the first sheet transport path 25 by being guided in the corresponding diverted direction by the flapper 21 and is discharged onto the discharged sheet tray 9 without failure by being pinched between the F/U sheet discharge roller 6*a* and the roller 23 contacting the roller 6*a*.

When the flapper 21 is in the F/D position as shown in FIG. 4, sheet S transported from the fixing device 3 is led into the second sheet transport path 26 by being guided in the corresponding diverted direction by the flapper 21 and is discharged onto the discharged sheet tray 12 in the F/D state by a pair of sheet discharge rollers 11.

As described above, the flapper 21 and the F/U sheet discharge roller 6*a* are arranged to discharge sheet S without providing any special discharge roller, thereby reducing the space occupied by the sheet discharge mechanism. Moreover, since sheet S discharged in the F/U state is pressed against the F/U sheet discharge roller 6*a* by the roller 23, sheet S can be discharged onto the sheet discharge tray 9 without failure.

Figure 6A:
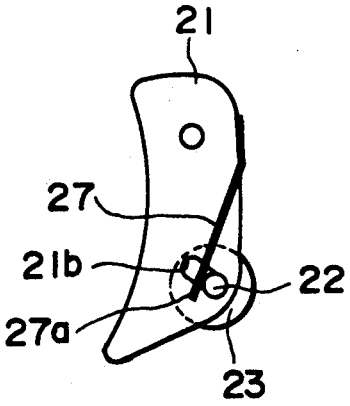
FIG. 6A is a side view of a branch means of a sheet discharge mechanism in accordance with a second embodiment of the present invention.
Figure 6B:
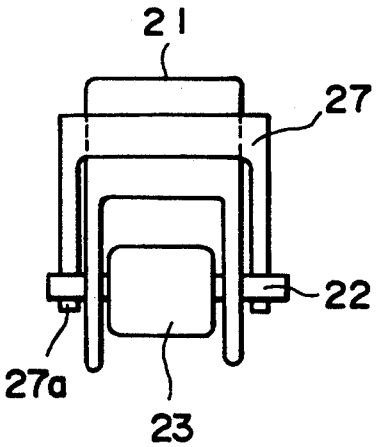
FIG. 6B is a from view of the branch means shown in FIG. 6A.

FIG. 6 shows essential portions of a second embodiment of the present invention.

In the first embodiment, the roller 23 can move along the elongated holes of the arms 21*a* upward or downward and can be maintained in contact with the F/U sheet discharge roller 6*a* by its weight. However, a force may be applied to the roller 23 to suitably press the same against the F/U sheet discharge roller 6*a*.

Referring to FIG. 6, a base portion of a resilient member 27 formed of a plate spring is fixed to the flapper 21, and free ends of a pair of arms 27*a* formed on opposite sides of the resilient member 27 are engaged with opposite ends of the support shaft 22 on which the roller 23 is fixed. The roller 23 is thereby urged in a rightward downward direction as viewed in FIG. 6A, i.e., in the direction in which the support shaft 22 is pressed against the lower ends of the elongated holes 21*b* of the arms 21*a*. If the roller 23 is disposed on the flapper 21 while being urged by such a means, sheet S can be pressed against the F/U sheet discharge roller 6*a* more positively and the force of the F/U sheet discharge roller 6 and the roller 23 for transporting sheet S can be increased.

The embodiments in which the present invention is applied to a printer sheet discharge mechanism have been described. Needless to say, the present invention can also be applied to a sheet discharge mechanism or a sheet transport mechanism of a copier or the like.

I claim:

1. A sheet transport mechanism, comprising:

means for providing a plurality of transport paths for a sheet member;

a transport rotary member provided at a branch section at which the transport paths are branched;

a flapper provided at the branch section, said flapper selecting one of the plurality of transport paths and guiding the sheet member into the selected transport path by changing its posture, said flapper being rockably supported about a support point to be rocked between a first posture and a second posture; and a flapper rotary member supported on said flapper by a rotatable shaft apart from said support point, said flapper rotary member pinching the sheet member in cooperation with said transport rotary member to transport the sheet member when said flapper is in said first posture, but not forming a nip with said transport rotary member when in said second posture.

2. A sheet transport mechanism according to claim 1, wherein the plurality of transport paths include a first transport path through which the sheet member is led to a first discharge tray without being inverted with respect to its two surfaces, and a second transport path through which the sheet member is led to a second discharge tray while being inverted with respect to its two surfaces, said transport rotary member and flapper rotary member engaging each other when said flapper is in a posture to lead the sheet member to the first transport path.

3. A sheet transport mechanism according to claim 2, wherein said transport rotary member is a discharge roller for discharging the sheet member to the first discharge tray.

4. A sheet transport mechanism according to claim 1, wherein the plurality of transport paths include a first transport path through which the sheet member is immediately led to a first discharge tray, and a second transport path including a guide for leading the sheet member to a second discharge tray, and wherein said transport rotary member comprises a discharge roller for discharging the sheet member to the first discharge tray.

5. A sheet transport mechanism according to claim 3, wherein said flapper is supported so as to be swingable to a position for leading the sheet member to the first transport path or the second transport path, and wherein said flapper rotary member is supported on said flapper so as to be rotatable and movable generally vertically, said flapper rotary member being pressed against said discharge roller by its weight.

6. A sheet transport mechanism according to claim 4, wherein said flapper is supported so as to be swingable to a position for leading the sheet member to the first transport path or the second transport path, and wherein the flapper rotary member is supported on said flapper so as to be rotatable and movable generally vertically, said flapper rotary member being pressed against said discharge roller by its weight.

7. A sheet transport mechanism according to claim 3, wherein said flapper is supported so as to be swingable to a position for leading the sheet member to the first transport path or the second transport path, and wherein said flapper rotary member is supported on said flapper so as to be rotatable and movable generally vertically, said flapper rotary member being pressed against said discharge roller by a force of a spring.

8. A sheet transport mechanism according to claim 4, wherein said flapper is supported so as to be swingable to a position for leading the sheet member to the first transport path or the second transport path, and said flapper rotary member is supported on said flapper so as to be rotatable and movable generally vertically, said flapper rotary member being pressed against said discharge roller by a force of a spring.

9. A sheet transport mechanism according to claim 1, further comprising:

a pair of first feeding rollers disposed upstream of said transport rotary member, in a first path formed when said flapper is in the second posture;

a pair of second feeding means being disposed downstream of said transport rotary member, in a second sheet path formed when said flapper is in the first posture; and a sheet discharge tray disposed downstream of said transport rotary member.

10. An image forming apparatus, said apparatus comprising:

image forming means for forming an image on a sheet member;

means for providing a plurality of transport paths for the sheet member;

a transport rotary member provided at a branch section from which the transport paths are branched;

a flapper provided at the branch section, said flapper selecting one of the plurality of transport paths and guiding the sheet member into the selected transport path by changing its posture, said flapper being rockably supported about a support point to be rocked between a first posture and a second posture; and a flapper rotary member pivotably supported on said flapper by a rotatable shaft apart from said support point, said flapper rotary member pinching the sheet member in cooperation with said transport rotary member to transport the sheet member when said flapper is in said first posture, but not forming a nip with said transport rotary member when in said second posture.

11. An image forming apparatus, said apparatus comprising:

means for forming an image on a sheet member;

means for providing first and second transport paths for the sheet member;

a flapper provided at the branch section at which the first and second transport paths are branched, said flapper selecting one of the transport paths and guiding the sheet member into the selected transport path by swinging and changing its posture, said flapper being rockably supported about a support point to be rocked between a first posture and a second posture;

a transport roller for transporting the sheet member transported to the first transport path guided by said flapper; and a flapper roller pivotably supported on said flapper by a rotatable shaft apart from said support point, said flapper roller pinching the sheet member in cooperation with said transport roller to transport the sheet member when said flapper is in said first posture such as to guide the sheet member into the first transport path, but not forming a nip with said transport roller when in said second posture.

12. A sheet transport mechanism, comprising:

means for providing first and second transport paths for a sheet member;

a flapper provided at a branch section from which the first and second transport paths are branched, said flapper selecting one of the transport paths and guiding the sheet into the selected transport path by swinging and changing its posture, said flapper being rockably supported about a support point to be rocked between a first posture and a second posture;

a transport roller for transporting the sheet member transported to the first transport path guided by said flapper; and a flapper roller pivotably supported on said flapper by a rotatable shaft apart from said support point, said flapper roller pinching the sheet member in cooperation with said transport roller to transport the sheet member when said flapper is in said first posture such as to guide the sheet member into the first transport path, but not forming a nip with said transport roller when in said second posture.

* * * * *

UNITED STATES PATENT AND TRADEMARK OFFICE

CERTIFICATE OF CORRECTION

PATENT NO. : 5,201,518
DATED : April 13, 1993
INVENTOR(S) : Yuzo ISODA

It is certified that error appears in the above-indentified patent and that said Letters Patent is hereby corrected as shown below:

COLUMN 3
Line 13, "from" should read --front--.

COLUMN 5
Line 52, "second" should read --first--.
Line 55, "first" should read --second--.

COLUMN 6
Line 48, "sheet" should read --sheet member--.

Signed and Sealed this
First Day of March, 1994

Bruce Lehman

BRUCE LEHMAN
*Commissioner of Patents and Trademarks*

*Attest:*

*Attesting Officer*